United States Patent [19]

Schultz et al.

[11] Patent Number: 5,050,888

[45] Date of Patent: Sep. 24, 1991

[54] BOARD GAME METHOD

[76] Inventors: Ronald D. Schultz, Rte. 2 Box 785; Richard A. Krueger, 602 E. Adam St., both of Colby, Wis. 54421

[21] Appl. No.: 594,447

[22] Filed: Oct. 5, 1990

[51] Int. Cl.[5] ..... A63F 3/00; A63F 9/04

[52] U.S. Cl. ..... 273/248; 273/282; 273/146

[58] Field of Search ..... 273/246, 248, 249, 146, 273/282

[56] References Cited

U.S. PATENT DOCUMENTS

| | | | |
|---|---|---|---|
| 2,658,760 | 11/1953 | Brost | 273/246 |
| 2,823,919 | 2/1958 | Scruggs | 273/246 |
| 4,585,232 | 4/1986 | Sheppard et al. | 273/248 |

*Primary Examiner*—Benjamin Layno
*Attorney, Agent, or Firm*—Leon Gilden

[57] ABSTRACT

A board game including a playing board including a top surface with a plurality of tracks formed on the playing board each defined by a series of blind bores. Each of the tracks are arranged coextensively and coaxially relative to one another in a contiguous relationship. Each player of a plurality of players utilizing the game is provided with at least one peg for proceeding along each of the blind bores and a series of player dice and a single pacer die. The game is to numerically and by coloration associate coloration of the player dice with the pacer die member wherein each of the dye members utilized in the game are formed of three colorations with each of the colorations associated with a single digit of each six sided die member. Points are thusly derived are translated into movement of each peg along each respective track. A complete encircling of a single track by a player defines a winner.

1 Claim, 2 Drawing Sheets

BOARD GAME METHOD

BACKGROUND OF THE INVENTION

1. Field of the Invention

The field of the invention relates to board games, and more particularly pertains to a new and improved board game method and apparatus wherein the same provides for a continuously progressing and relatively fast paced moving game for amusement and entertainment of individuals.

2. Description of the Prior Art

Board games of various types and organizations have been utilized in the prior art for the entertainment and amusement of players. Such board games have consistently utilized an elaborate construction and organization of components to effect such play. Examples of the prior art include U.S. Pat. No. 4,465,283 to PILETTE et al wherein a maze type board game utilizes variously colored spaces to provide a maze of several alternative and dead end paths to confuse players with respect to a most direct route for movement of play about the board game from a start to finish orientation within the board game.

U.S. Pat. No. 4,331,333 to WILLCOCKS sets forth a board game wherein a tray utilizes a plurality of removable tiles that may be arbitrarily placed within the tray with directions placed on tiles for indication of direction of subsequent tiles and their positioning in an effort to effect difficultly in the positioning of tiles relative to a goal tile within the board.

U.S. Pat. No. 4,280,704 to MASSIMEI et al sets forth a board game simulating naval warfare utilizing a apertured grid provided for each player with a further apertured grid provided for each payer oriented 90 degrees relative to the first noted grid of each player for positioning of pegs when playing the game simulating naval warfare.

U.S. Pat. No. 4,208,054 to HAHN, JR. et al sets forth a board game provided with various concentric and radial paths and various movements provided along each path.

U.S. Pat. No. 4,184,685 to WALSON sets forth a game apparatus utilizing a plurality of playing surfaces or fields of a multi-coloration with steer members positionable within recesses of the playing fields for indication of relative positioning of each of the positions of relative players in play of the instant game.

As such, it may be appreciated that there continues to be a need for a new and improved method and apparatus of playing a board game as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of board game method and apparatus present in the prior art, the present invention provides a new and improved board game method utilizing a plurality of multi-colored die members to effect rapid and sequential positioning of tokens directed about a playing field with each of the tokens directed about individual pathway in the playing field. As such, the general purpose of the present invention, which will be described subsequently in greater detail, is to provide a new and improved board game method which has all the advantages of the prior art board game methods and none of the disadvantages.

To attain this, the board game method and apparatus of the instant invention includes a board game including a playing board including a top surface with a plurality of tracks formed on the playing board each defined by a series of blind bores. Each of the tracks are arranged coextensively and coaxially relative to one another in a contiguous relationship. Each player of a plurality of players utilizing the game is provided with at least one peg for proceeding along each of the blind bores and a series of player dice and a single pacer die. The game is to numerically and by coloration associate coloration of the player dice with the pacer die member wherein each of the die members utilized in the game are formed of three colorations with each of the colorations associated with a single digit of each six sided dye member. Points are thusly derived are translated into movement of each peg along each respective track. A complete encircling of a single track by a player defines a winner.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game method and apparatus which has all the advantages of the prior art board game method and apparatus and none of the disadvantages.

It is another object of the present invention to provide a new and improved board game method and apparatus which may be easily and efficiently manufactured and marketed.

It is a further object of the present invention to provide a new and improved board game method and apparatus which is of a durable and reliable construction.

An even further object of the present invention is to provide a new and improved board game method and apparatus which is susceptible of a low cost of manufacture with regard to both materials and labor, and which accordingly is then susceptible of low prices of sale to the consuming public, thereby making such board game method and apparatus economically available to the buying public.

Still yet another object of the present invention is to provide a new and improved board game method and apparatus which provides in the apparatuses and methods of the prior art some of the advantages thereof, while simultaneously overcoming some of the disadvantages normally associated therewith.

Still another object of the present invention is to provide a new and improved board game method and apparatus which may be compactly stored when not being utilized.

Yet another object of the present invention is to provide a new and improved board game method and apparatus wherein the same utilizes multi-colored die and their association numerically and by coloration of a pacer die to effect movement of a respective token of respective players about a playing field of a board game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
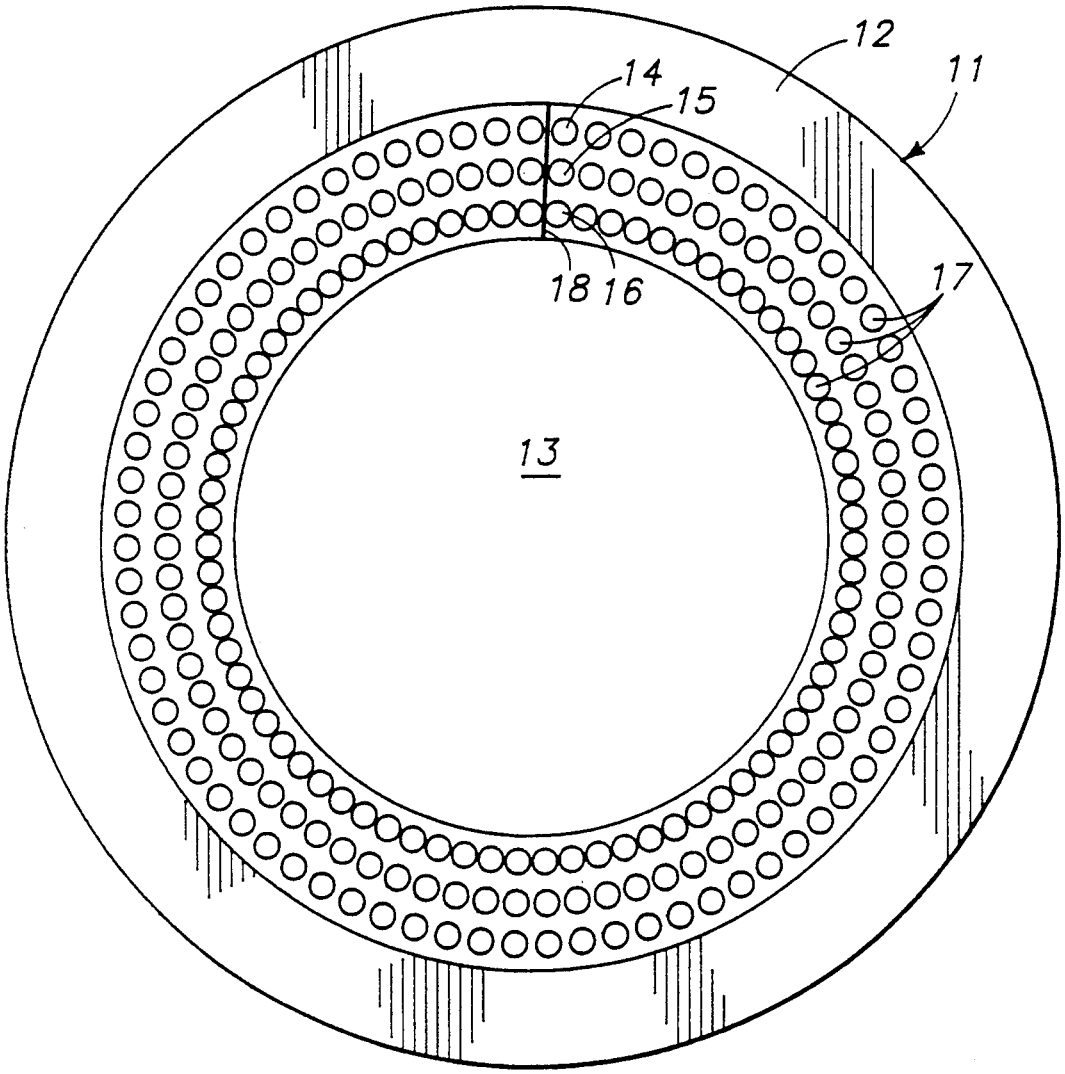
FIG. 1 is a top orthographic view of the game board of the instant invention.
Figure 2:
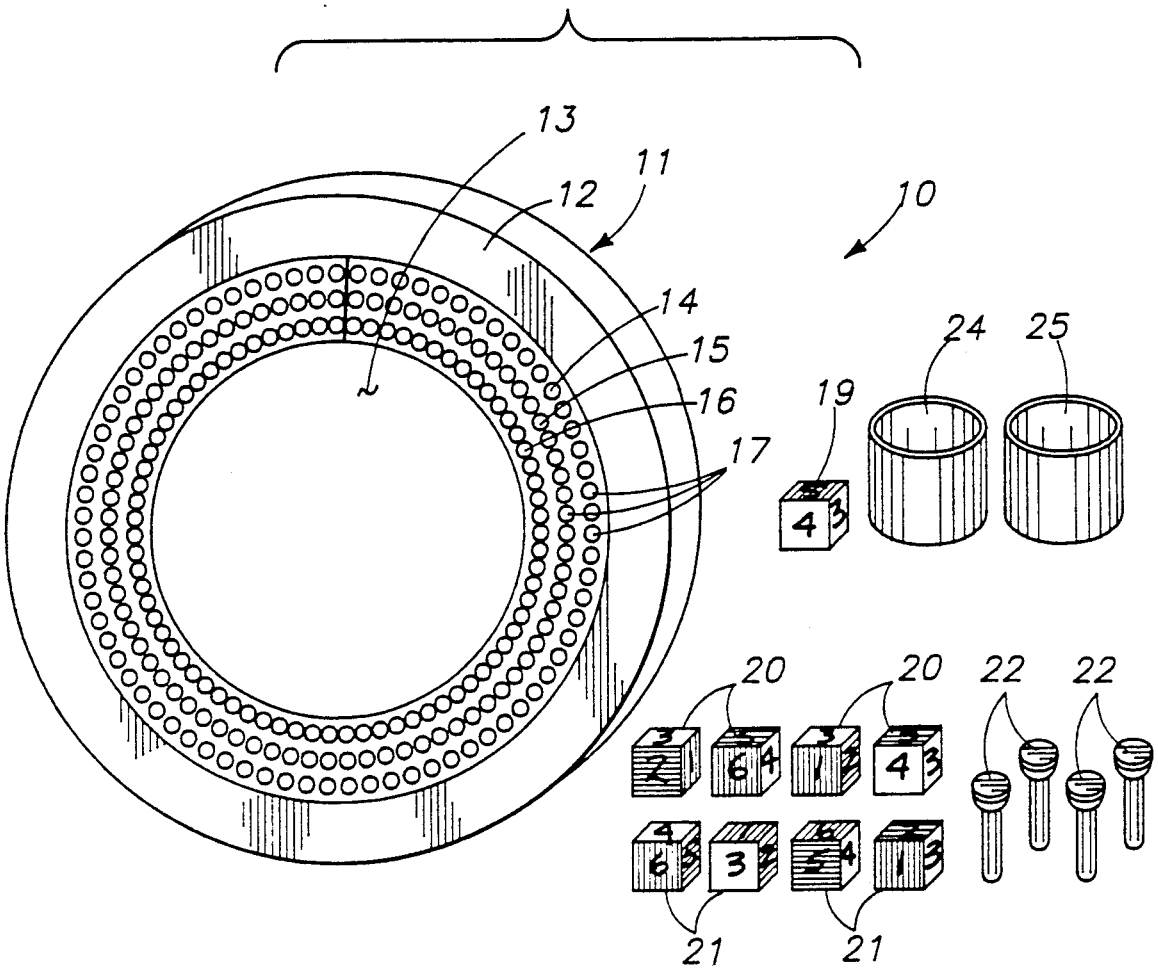
FIG. 2 is an isometric illustration of the apparatus utilized by the instant invention.
Figure 3:
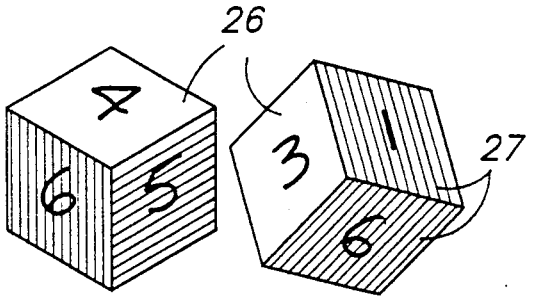
FIG. 3 is an isometric illustration of a plurality the die members indicating their multi-colorations.
Figure 4:
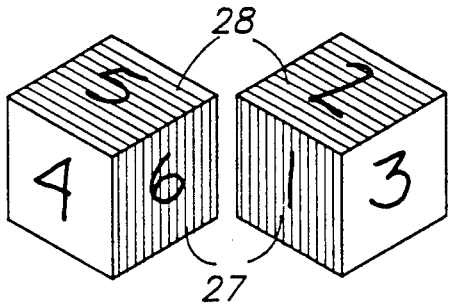
FIG. 4 is an isometric illustration of the plurality of die illustrating their multi-coloration arrangement.

With reference now to the drawings, and in particular to FIGS. 1 to 4 thereof, a new and improved board game method and apparatus embodying the principles and concepts of the present invention and generally designated by the reference numeral 10 will be described.

More specifically, the board game method and apparatus 10 of the instant invention essentially comprises game board 11 including a top surface 12 and a central circular surface 13. Positioned exteriorly of the and about the circular surface 13 are a series of concentric rings defined by a first outer annular track 14, a second central track 15, and a third inner track 16. The tracks are as noted are concentric and contiguous relative to one another and coextensively arranged in a continuous manner about the top surface 12. Each of the tracks are defined of a series of blind bores 17 positioned adjacent one another in a equally spaced relationship within each track. A starting line 18 defines a point of origination and termination with tokens utilized by the board game positioned adjacent the starting line 18 to begin traverse of a respective track whereupon crossing of the starting line 18 terminates play of a single game.

Provided in the game is a pacer die 19 with the die defined by six sides of three different colorations with two colorations of a series of the three colorations utilized within two sides of each die. Similarly, wherein a respective first and second die set 20 and 21 are provided each player and typically defined by four die members, each die member of the die sets are defined by the same coloration patterning as noted. More specifically, a first coloration 26 such as white encompasses two sides of each die member and the numbers 3 and 4. A second coloration 27 such as red encompasses two sides of a dye member and the numbers 6 and 1. A third coloration 28 such as blue defines 2 remaining sides of each die member and the numbers 5 and 2. Each player is provided a positioning peg or token wherein each positioning peg 22 defined by a T-shaped configuration with an elongate shank to complementarily be received within one of the blind bores of each track member. Further, a respective dice cup of the first and second dice cup members 24 and 25 respectively are provided with each player receiving a single dice cup for the random agitation of the die members 19 and 20 or 19 and 21 with each players respective turn.

Typically, each track is defined by 75 peg holes and while illustrated as three tracks may typically include four tracks with a single peg for each of the players provided. At onset of the game, a single die member is rolled and a player to begin or initiate play is decided by either a highest or lowest rolling of a die member. In event of a tie, the die member for deciding a starting player is rolled until a starting player is declared.

Each player throws a single die or the pacer die 19 with the pacer die defining a coloration and number used in the counting of points. Each player then randomly agitates and throws the remaining die members of each die set wherein matching of numbers and coloration in relationship to the pacer die 19 determines a point total and each point of the point total determines and defines movement of one blind bore 17 about a respective track for each player. For example when two matching colors of the pacer and associated die of a respective die set is thrown, a player is awarded two points. Three matching colors is defined by four points, four matching colors defined by eight points, and five matching colors where the pacer and each die of the die set 20 or 21 are of a same color defines twelve points. Similarly, one pair of numbers of the pacer and an associated die member of a die set is defined by two points, three of a same number defines six points, four of a same number defines eight points, and five of a same number defines twenty points. Accordingly, in an example if a pacer die member is thrown with a white die number four, a first player of a plurality of players throws a remaining four die members of a die set with three white number four die and a number six die, that player receives eight points for the four matching light colorations, and a further eight points for the four matching numbers four. Accordingly sixteen points are awarded that player and that player may traverse sixteen blind bores of a respective track of one the tracks 14 through 16.

As to the manner of usage and operation of the game of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a board game by a plurality of players comprising the steps of, A. providing a player board to include a plurality of individual tracks with each track formed of a series of blind bores, and B. providing each of the players with a predetermined number of player die, and C. providing a single pace die member, and D. providing each of the players with at least one peg member wherein each peg member is formed for complementary reception within one of said bores, and providing each of the player die members and the pace die member with six sides, and providing each of the six sides with a differing whole integer representation, and alternatively directing each of the players to throw the pace die member, and subsequently throw the player die members and match integer representations of the player die members with the pace die member for indicating movement along a respective track by a respective player, and wherein step B further includes providing each player die member and pace die member with a first coloration of two sides of the six dies, and a second coloration of two further sides of the six sides, and a third coloration of two further sides of the six sides, and awarding points for matching of the first, second, and third colorations with a first, second, or third coloration indicated by the pace die member, and wherein a point total defined by matching of the colorations and the point total defined by matching of the integers of the pace die member and the player die members are totaled to define a total score and the total score as a whole integer indicates a one to one relationship of a predetermined number of blind bores of a respective track to be traversed by a respective player.

* * * * *